United States Patent [19]

Corey

[11] Patent Number: 4,532,765

[45] Date of Patent: Aug. 6, 1985

[54] STIRLING ENGINE WITH AIR WORKING FLUID

[75] Inventor: John A. Corey, North Troy, N.Y.

[73] Assignee: Mechanical Technology Incorporated, Latham, N.Y.

[21] Appl. No.: 605,476

[22] Filed: Apr. 30, 1984

[51] Int. Cl.[3] ..... F02G 1/04

[52] U.S. Cl. ..... 60/517; 60/526

[58] Field of Search ..... 60/517, 525, 526

[56] References Cited

U.S. PATENT DOCUMENTS 4,055,953 11/1977 Nederlof ..... 60/517 X 4,195,554 4/1980 Rosenquist ..... 60/517 X

*Primary Examiner*—Allen M. Ostrager

*Attorney, Agent, or Firm*—Joseph C. Sullivan; Joseph V. Claeys

[57] ABSTRACT

A Stirling engine capable of utilizing air as a working fluid which includes a compact heat exchange module which includes heating tube units, regenerator and cooler positioned about the combustion chamber. This arrangement has the purpose and effect of allowing the construction of an efficient, high-speed, high power-density engine without the use of difficult to seal light gases as working fluids.

8 Claims, 8 Drawing Figures

FIG.5
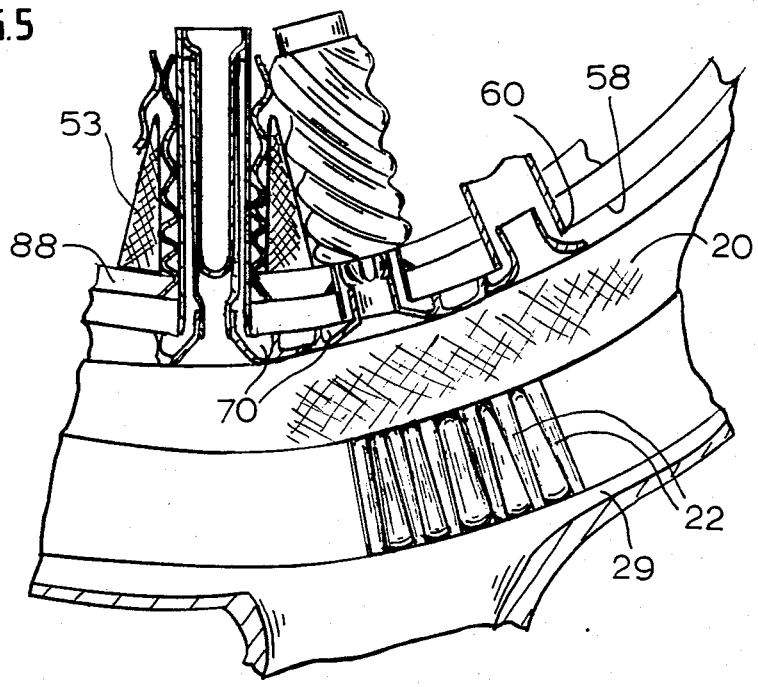
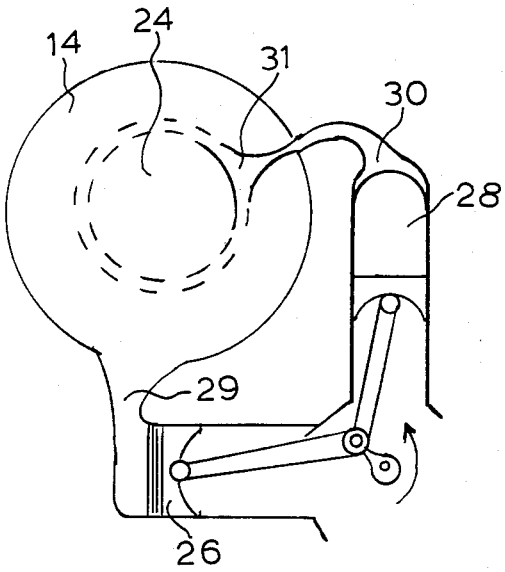
FIG.3

STIRLING ENGINE WITH AIR WORKING FLUID

FIELD OF THE INVENTION

With the renewed and ever expanding interest in Stirling engines, efforts have been made to continually improve upon their design. Basic Stirling engine principals of operations are set forth in a text entitled, "Stirling Engines" by G. Walker, 1st Edition, 1980. Essentially, in this regard, a Stirling engine operates on the principal of heating and cooling a working fluid (gas), with the expansion and compression of the gas utilized to perform useful work. A variety of designs are illustrated in the aforenoted text with their attendant advantages.

A great many designs of Stirling engines utilize lighter-than-air gases such as hydrogen or helium as the working fuid due to their relatively high conductivity, lighter specific heat and lower viscosity. While the use of such gases has its advantages, an important requisite is to maintain a fixed inventory of the working gas, thus requiring that a sealed cycle is maintained.

As an alternative to the lighter gases, air has been used. A distinct advantage of an air-cycle Stirling engine as compared to the fixed inventory lighter than air engine is that of the nature of the sealing between the working spaces and ambient conditions. Current hydrogen and helium engines use a sliding seal on a rod between the pistons and crossheads.

Because of the clearance requirements of this arrangement, engine height and volume are penalized to accommodate it. Since an air cycle engine in an air environment would not need near perfect sealing because any leakage can be easily replaced from the environment, such an engine would not only avoid the elaborate sealing arrangements utilized but also could use the volume and weight saved by that avoidance to its advantage.

Heretofore, however, due to the poor transport and fluid properties of air, (i.e., lower conductivity, lower specific heat and higher viscosity), designs of Stirling engines utilizing air as a working fluid have not been entirely satisfactory. Attempts to compensate for relatively poor fluid properties, usually resulted in extremely large, inefficient engines having low power-to-weight ratio. While efficiencies in an air-cycle engine as compared to those engines utilizing the lighter gases has heretofore been possible, it has usually been realized only at low speeds and low specific power, thus limiting their applications.

SUMMARY OF THE INVENTION

Accordingly, it is a principal object of the present invention to provide for an air-cycle Stirling engine which is relatively efficient and capable of widespread application similar to that enjoyed by lighter-than-air cycle engines in high-speed, high power-density duty.

It is a further object of the present invention to provide for such an air-cycle Stirling engines, which is relatively simple in design and relatively inexpensive.

It is another object of the present invention to provide a Stirling engine which removes certain of the shortcomings of the lighter-than-air working fluid engines, particularly the rigid sealing requirements.

The present invention provides for an air-cycle Stirling engine which is a viable alternative to, for example, hydrogen or helium engines. In this regard, through the use of an improved heat exchanger design, the shortfalls of using air as a working fluid are overcome. Moreover, the present heat exchanger design allows an engine having a weight and volume comparable to e.g., hydrogen cycle engines, with however, a simpler, cheaper and more reliable construction.

In this regard, the present invention provides for a heat exchange module which integrates in a layered fashion the heater, regenerator and cooler about the combustion chamber as a compact and inexpensive unit. The particular heater tube construction, regenerator and cooler design allows for effective heat transfer in a compact situation necessary for an air-cycle engine while being relatively simple and inexpensive.

BRIEF DESCRIPTION OF THE DRAWINGS

Thus, by the present invention, the aforenoted objects and advantages and others will be realized, the description of which should be taken in conjunction with the drawings, wherein:

FIG. 3 is a somewhat schematic representation illustrating the relationship between the heat exchange module and the expansion and compression pistons;

FIG. 5 is an enlarged, partially sectional top view of a portion of the heat exchange module positioned within the Stirling engine;

DETAILED DESCRIPTION OF THE PREFERRED EMBODIMENT

Figure 1:
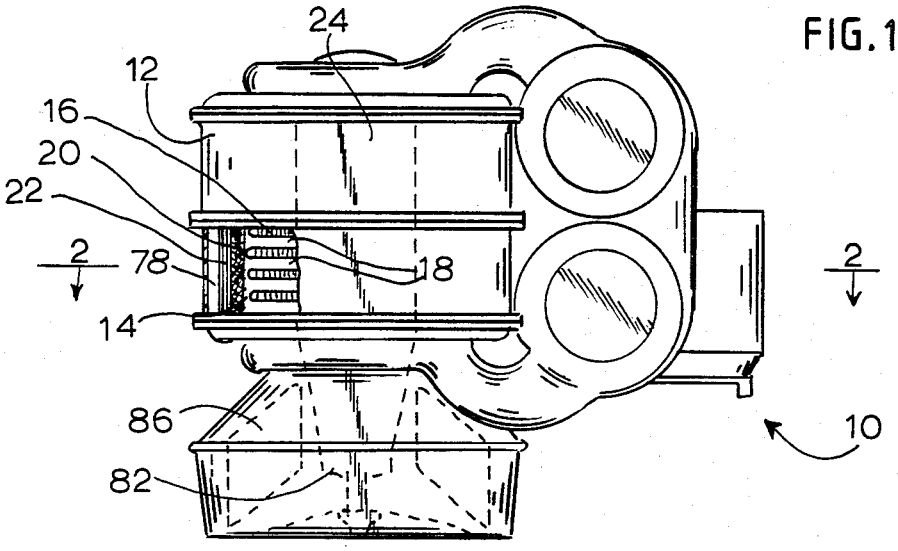
FIG. 1 is a side, partially sectional view of the Stirling engine incorporating the teachings of the present invention.
Figure 2:
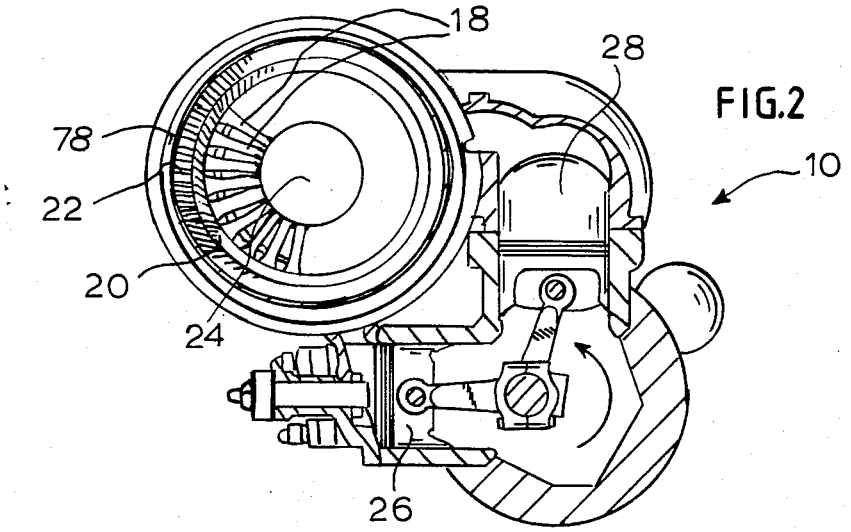
FIG. 2 is a top partially sectional view of the Stirling engine incorporating the teachings of the present invention.

With more particular regard to the drawings, there is generally shown a Stirling cycle or engine 10 which is designed to utilize air as its working fluid. The engine includes an outer casing 12 in which is positioned a heat exchange module 14 which includes a heater tube matrix 16 comprised of individual heater tubes 18, a regenerator 20 and a cooler 22 successively positioned in a layered fashion about the combustion chamber 24, as shown in FIGS. 1 and 2.

The general relationship between the heat exchange module 14 and the compression (cold) and expansion (hot) pistons 26 and 28 respectively, which are part of the engine, can best be described with reference to FIG. 3. The pistons are shown on a common crank and are displaced spatially to cause the expansion piston 28 to lead the compression piston 26 by some angle (i.e. 90°). The cold compression piston 26 is coupled to a cold compression duct 29 and drives air through the heat exchange module 14 where it is heated. A hot connecting duct 30 communicates between the expansion space and a ring duct 31 which picks up the heated air from the heat exchange module 14. Piston 18 is driven by the heated air with the oscillating air flow back and forth generating work in accordance with well known Stirling engine principals.

Figure 4A:
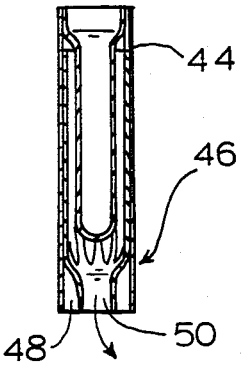
FIG. 4A is a sectional view of an assembled heating tube unit incorporating the teachings of the present invention.
Figure 4:
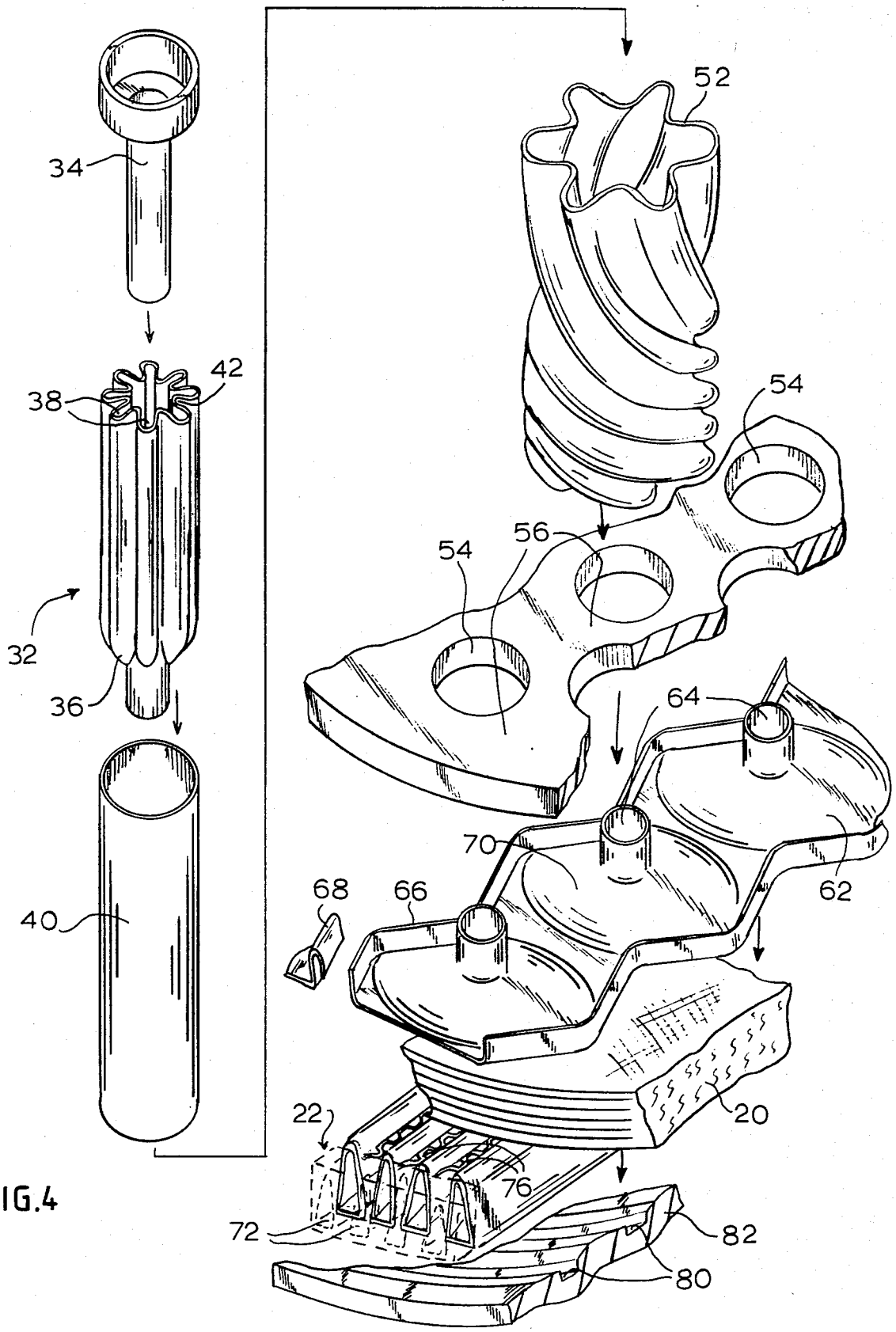
FIG. 4 is an exploded, partially sectional view of portions of the heat exchange module, incorporating the teachings of the present invention.

The present invention minimizes the volume or space required for the components involved in the heat exchanger i.e., heating tubes, regenerator and cooler. In this regard and with reference to FIG. 4, the heater exchange module 14 is shown in an exploded view. The heater tube unit 32, made of highly thermally conductive material, includes a flared, blind ended, deep draw member 34 around which snugly fits a crenulated open ended tube 36 to form channels 38 therebetween. This in turn then snugly fits into a plain open ended tube 40 which forms channels 42. The assembly is then brazed into a single heater tube unit as shown in FIG. 4A. Since the unit is fully brazed, hoop stress is largely taken on the small effective passage diameter allowing thin walls and good thermal performance. The members 34–36 are relatively simple allowing for inexpensive production and assembly. Like the cooler (to be discussed), the heater needs many air passages which are shorter and finer than those heretofore utilized on the lighter gas engines.

The heater tube unit 32 is essentially an annular collection of gas passages or channels from space 44 to space 46 and back again with simple coaxial manifolds. Air entering at 48 would flow between members 36 and 38 via channels 42 to space 44 then reverse directions and flow down between 34 and 36 via channels 38 and out opening 50 of tube 36 and vice versa. The effective number of passages is determined by the number of crenulations on tube 36.

The heat transfer to the air flowing within the heater tube may be enhanced by finning or perhaps by adding a varied pitch fluted tube 52 about it so as to swirl the combustion gas in the channels formed therebetween which would exit as exhaust. FIG. 5 shows the optional use of such fluted tubes with the heater tube units 32. These tubes are positioned in openings in a cylindrical fiber ceramic manifold 53 in the combustion chamber 24 as shown in the drawings. To achieve a similar result to using the fluted tube, the openings in the ceramic manifold 53 may be grooved to provide the desired swirling of the combustion gas.

A large amount of tube assemblies 32 are utilized and positioned radially in layered rows about the combustion chamber as shown in the figures. They are short and small in diameter, are capable of high performance, and may be mechanically assembled by pre-manifolding a number of tube units thereby reducing assembly costs.

Figure 7:
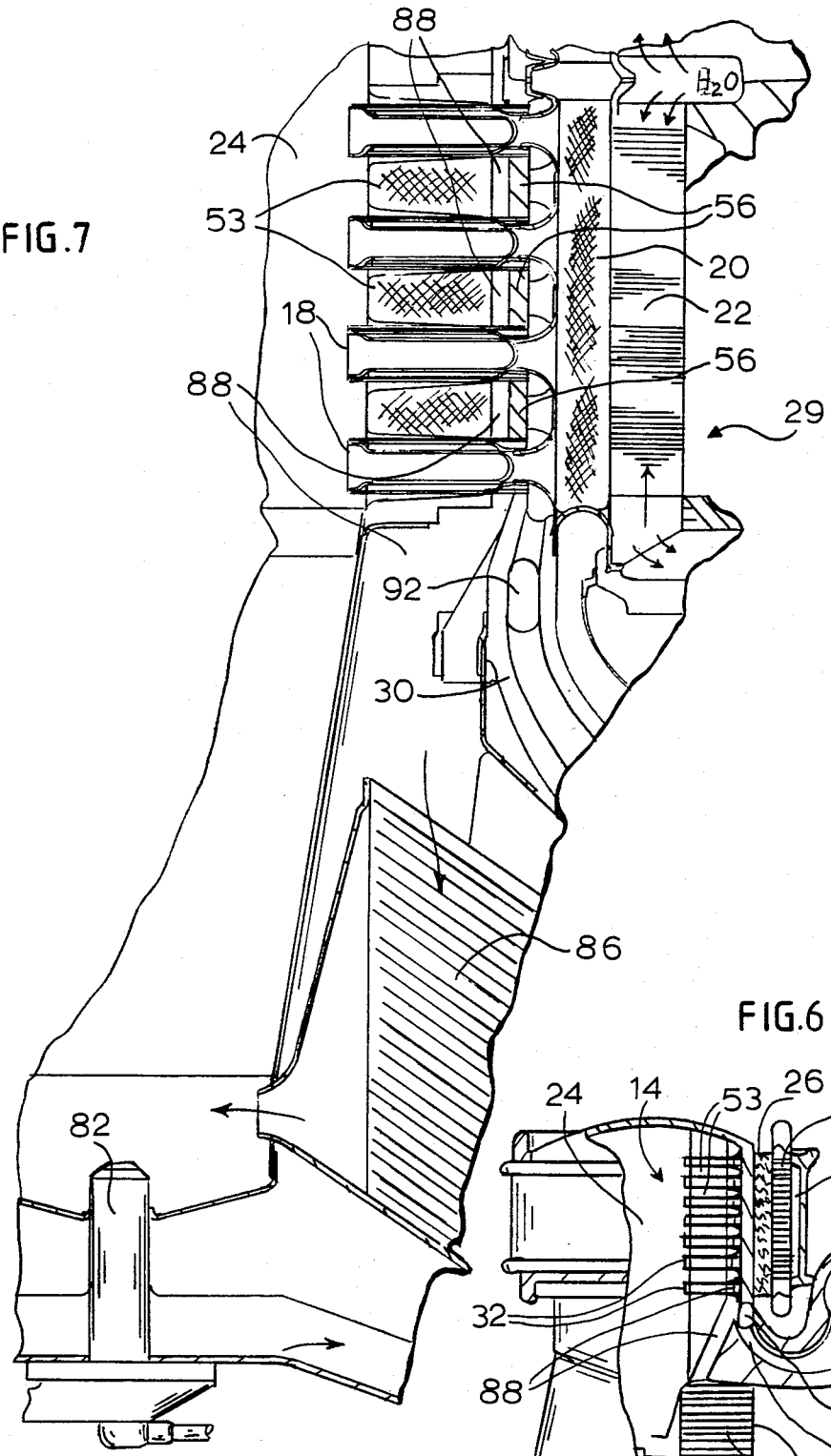
FIG. 7 is an enlarged side sectioal view of a portion of the heat exchange module positioned within the Stirling engine shown in FIG. 6.

Each heater tube unit 12 is fitted radially inside openings 654 in a high pressure cylinder 56 positioned about the combustion chamber 24 and affixed thereto. In this regard, the end of tube 38 is flush with the outer surface 58 of cylinder 56 as shown most clearly at 60 in FIGS. 5 and 7.

Manifold 62 is then provided and is formed out of a thin sheet and punched to create raised openings 64 which are axially positioned with respect to openings 54. Openings 65 slide into engagement with the interior surfaces of the opening 50 in the heater tube units 32. Manifold 62 inlcudes raised interlocks 66 which allow the ready coupling of adjacent manifolds 68. The manifold 62 are fitted around the cylinder 56 such that an annulus space 70 is defined therebetween which communicates with channels 42 on the heater tubes 32 and is coupled with the expansion space 28, as will be discussed. In addition, the channels 38 are restricted to communicating with the space outside the manifold 62 via the openings 64.

In this latter space, there is wrapped the regenerator matrix 20. It has been found that a regenerator fabricated out of a ceramic fiber such as Nextel 312 manufactured by the 3M Company, in a spiral wound mesh is very effective. Such heat resistant fibers are strong and flexible allowing for thin weaving and are low in conductivity. In the present invention, the use of such fibers is advantageous since with a conventional regenerator material, the short length in the temperature gradient direction would have an undesired amount of conduction loss which is here avoided. Such fibers provide high regenerator effectiveness and prevent loss of heat from hot to cold faces and have been found superior to the metallic wire designs heretofore utilized.

Positioned about the regenerator 20 is a radial gas flow cylindrical cooler 22 which comprises numerous hollow tapered tubes 72 assembled into a ring 74. Positioned between the tubes 72 are folded metal finstocks 76. The entire assembly of tubes 72 and finstocks 76 with perhaps end plates shown in phantom to keep them assembled, may then be brazed as a unit much like a conventional automobile radiator. Through the hollow of the tube 72 is passed the coolant ($H_2O$) while through the channels formed by the finstocks 76 flow the working gas (air).

Note that rather than using finstocks, the tubes themselves may be provided with transversal grooves in the walls thereof; such grooves being in a zone between the ends to form the channels for air and then brazed together. By either method, many thousands of efficient passages are inexpensively made with few parts while having high thermal performance.

This entire heat exchange module 14 is then positioned in the engine 10. Located between the cooler 22 and the external casing 12 is the cold connecting channel which communicates with duct 29 and which may include channels 80 formed in a cold pressure cylinder or manifold 82 which may be part of the external casing 12.

Figure 6:
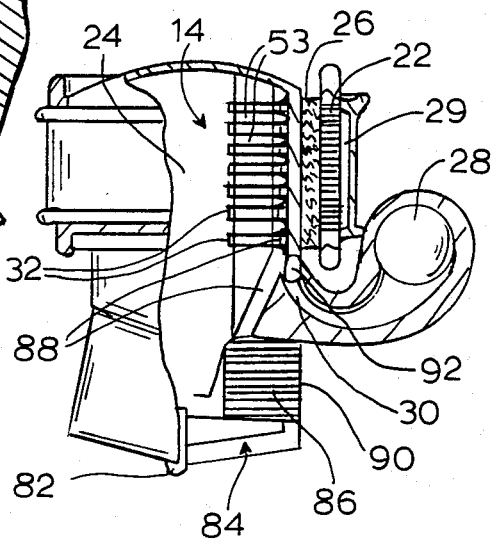
FIG. 6 is a side partially sectional view looking toward the axis of the expansion piston of the Stirling engine.

With reference now to FIG. 6, a general description of the engine's operation is as follows. A combustor system 82 is provided for heating the heater tubes 32 and in turn the working fluid (air) passing through the tubes. Air for combustion enters at. 84 and passes through a standard recuperative preheater 86 into the combustion chamber 24. From there, it moves axially along the heater tube units 32, through the ceramic manifold 53 (or fluted tube 52) and then to a return annulus 88, through the preheater 86 and out as exhaust at 90.

Movement of the working fluid (air) would be along the following paths. The expansion piston 28 is coupled to the hot connecting duct 30 and the ring duct 31 which is coupled to annulus space 70 between the manifold 62 and the cylinder 56. The channels 42 of the heater tubes are coupled with this area. The cold connecting duct 29 communicates with the channels formed by the finstocks 76, through the regenerator 20 and to the channels 38 formed in the heater tubes 32 via manifold 50.

Oscillating flow in the heater tubes between the channels as discussed earlier completes the cycle. Working fluid (air) from the expansion space is introduced axially into the annulus space 70, and flows up and down through the heater tube channels and out through the regenerator and cooler (both radial flow) then around the channels 80 and into the compression space.

Note that this cylindrical structure having radial flow allows for a very large flow area without high hoop and vessel stress that normally occur with the large diameter vessels associated with large flow areas for axial flow. In addition, the structure is largely self-insulating having attendant advantages.

Also, additional Stirling cycles may be added on the same crankshaft with their heat exchange module sharing the same combustor adding to the versatility and efficiency of such a system.

Thus, by the present invention, its objects and advantages are realized and although a preferred embodiment has been disclosed and described in detail herein, its scope should not be limited thereby, rather its scope should be determined by that of the appended claims.

What is claimed is:

1. A Stirling engine which includes a compression means and expansion means; a combustion chamber for generating heat; a cylindrical shaped heat exchange module positioned about the combustion chamber to accept the transfer of heat therefrom, said heat exchange module includes a plurality of heater tube units positioned circumferentially about said combustion chamber and through which working gas passes and is heated, regenerator means in the form of a fiber matrix, cooling means for cooling the working fluid, said heating tube units, regenerator means and cooling means, each being cylindrical in shape and positioned respectively in a layered fashion each about the next; cold connecting duct means coupling the cooling means with the compression means so as to enable the passing of the working fluid therebetween; hot connecting duct means coupling the heating means with the expansion means so as to enable the passing of working gas therebetween; and said compression and expansion means operate to provide a periodic flow of working gas through the heat exchange module in a Stirling cycle of operation.

2. The invention in accordance with claim 1, wherein said heater tube units respectively comprise a cylindrical tube closed at one end and open at the other end having channels formed therein so as to allow the working gas to enter the tube at the open end via a first set of channels and exit the tube at the open end via a second set of channels.

3. The invention in accordance with claim 2, wherein said tubes are coupled at the open end to a cylinder wall.

4. The invention in accordance with claim 3, which further includes manifold means positioned between said cylinder wall and regenerator means and coupled with the heater tube units, said manifold means in conjunction with the cylinder wall defines a passage which communicates said first set of channels to the expansion means; and openings in said manifold means coupled with said second channels so as to allow the passing of working gas from the second channel to the regenerator means.

5. The invention in accordance with claim 4, wherein said regenerator means comprises a ceramic fiber matrix cylindrically shaped and positioned about said manifold means.

6. The invention in accordance with claim 5, wherein said cooling means comprises a plurality of substantially straight hollow tube members through which coolant passes formed into a cylinder and positioned about said regenerator means; and transverse channels formed between said tube members to allow the passing of working fluid from the regenerator means to the cold connecting duct.

7. The invention in accordance with claim 6, which further includes cylindrical ceramic manifold means disposed in said combustion chamber having openings therein in which a portion of said heater tube units are disposed.

8. The invention in accordance with claim 7, which further includes fluted tube members positioned about the portion of the heater tube unit disposed in the ceramic manifold so as to cause a swirling of the combustion gas thereabout during operation of the engine.

* * * * *

UNITED STATES PATENT AND TRADEMARK OFFICE

CERTIFICATE OF CORRECTION

PATENT NO. : 4,532,765

DATED : August 6, 1985

INVENTOR(S) : John A. Corey

It is certified that error appears in the above-identified patent and that said Letters Patent are hereby corrected as shown below:

Column 1, after "STIRLING ENGINE WITH AIR WORKING FLUID" insert the following paragraph:

--The Government of the United States of America has rights in this invention pursuant to Contract DEN3-32 awarded by the United States Department of Energy.--

Column 2, line 42, change "sectioal" to --sectional--.

Signed and Sealed this

*Twenty-fourth* Day of *December 1985*

[SEAL]

*Attest:*

DONALD J. QUIGG

*Attesting Officer*

*Commissioner of Patents and Trademarks*